US009098026B2

(12) United States Patent
Aiko

(10) Patent No.: US 9,098,026 B2
(45) Date of Patent: Aug. 4, 2015

(54) IMAGE FORMING APPARATUS INCLUDING INDUCTION HEATING FIXING UNIT

(75) Inventor: Yasuyuki Aiko, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 102 days.

(21) Appl. No.: 13/214,090

(22) Filed: Aug. 19, 2011

(65) Prior Publication Data

US 2012/0263486 A1 Oct. 18, 2012

(30) Foreign Application Priority Data

Apr. 18, 2011 (WO) ..... PCT/JP2011/059560

(51) Int. Cl.
*G03G 15/20* (2006.01)

(52) U.S. Cl.
CPC ..... *G03G 15/2039* (2013.01); *G03G 15/2053* (2013.01)

(58) Field of Classification Search
CPC ..... G03G 15/205; G03G 15/2039
USPC ..... 399/67
See application file for complete search history.

(56) References Cited

U.S. PATENT DOCUMENTS 6,317,571 B1 * 11/2001 Adams ..... 399/67
7,582,849 B2 * 9/2009 Watanabe et al. ..... 219/481
8,036,556 B2 * 10/2011 Kinouchi et al. ..... 399/69
2007/0088963 A1 * 4/2007 Nakaya ..... 713/300
2007/0280720 A1 * 12/2007 Kimura ..... 399/88
2008/0118265 A1 * 5/2008 Kinouchi et al. ..... 399/70
2010/0104297 A1 * 4/2010 Hata ..... 399/33

FOREIGN PATENT DOCUMENTS

JP 2003-229239 A 8/2003
JP 2008-250060 A1 10/2008
JP 2008-250061 A 10/2008
JP 2008-292988 A 12/2008

* cited by examiner

*Primary Examiner* — Walter L Lindsey, Jr.
*Assistant Examiner* — Philip Marcus T Fadul
(74) *Attorney, Agent, or Firm* — Canon USA, Inc. IP Division

(57) ABSTRACT

An image forming apparatus includes an image forming unit for forming a toner image on a sheet of paper; a fixing unit for fixing the toner image formed on the sheet of paper by heat; a power control unit for, when power to be supplied to the fixing unit is increased, determining an amount of increase of the power; and a current limiting unit for determining whether current consumption of the image forming apparatus exceeds an upper limit value in response to an increase of the amount of increase determined by the power control unit and, if it is determined that the current consumption exceeds the upper limit value, decreasing the amount of increase of the power determined by the power control unit.

5 Claims, 18 Drawing Sheets

IMAGE FORMING APPARATUS INCLUDING INDUCTION HEATING FIXING UNIT

TECHNICAL FIELD

Embodiments of the present invention relate to temperature and power control of a fixing unit, particularly, an induction heating fixing unit in an electrophotographic image forming apparatus.

BACKGROUND ART

In electrophotographic copiers, sheets of paper are heated and pressurized by fixing units in order to fix toner images formed on the sheets of paper. A large amount of power is required to heat the fixing units. The power consumed in such an image forming apparatus tends to increase in response to a request to, for example, increase the processing speed. At the same time, an upper limit is set for the current value capable of being acquired from a single outlet of a commercial power supply. For example, the current value is set within 100V/15 A in Japan. Accordingly, it is necessary to set the power consumed in the image forming apparatus to a value lower than the power capable of being supplied from the commercial power supply.

To this end, the total amount of current consumption in the image forming apparatus is measured to control the power to be supplied to the fixing unit in accordance with the result of the measurement (for example, refer to Japanese Patent Laid-Open No. 2008-292988).

However, when an apparatus is operated in a state in which the total amount of current consumption of the apparatus is close to a current limit value, a state in which the power exceeds the limit value and a state in which the power is lower than the limit value are repeated to cause many ripples in the fixing power. Accordingly, it is not possible to efficiently use the power and a moment at which the total amount of current consumption exceeds an upper threshold value occurs.

One disclosed aspect of the embodiments provides a technology to keep the maximum productivity of an image forming operation by preventing the current consumption from exceeding a limit value and efficiently using the power within the limit.

SUMMARY OF INVENTION

In order to achieve the above problem, an image forming apparatus of one disclosed aspect of the embodiments includes an image forming unit for forming a toner image on a sheet of paper; a fixing unit for fixing the toner image formed on the sheet of paper by heat; a power control unit for, when power to be supplied to the fixing unit is increased, determining an amount of increase of the power; and a current limiting unit for determining whether current consumption of the image forming apparatus exceeds an upper limit value in response to an increase of the amount of increase determined by the power control unit and, if it is determined that the current consumption exceeds the upper limit value, decreasing the amount of increase of the power determined by the power control unit.

Further features of the present invention will become apparent from the following description of exemplary embodiments with reference to the attached drawings.

DESCRIPTION OF EMBODIMENTS

First Embodiment

Embodiments of the present invention will herein be described with reference to the attached drawings.

One disclosed feature of the embodiments may be described as a process which is usually depicted as a flowchart, a flow diagram, a timing diagram, a structure diagram, or a block diagram. Although a flowchart or a timing diagram may describe the operations or events as a sequential process, the operations may be performed, or the events may occur, in parallel or concurrently. In addition, the order of the operations or events may be re-arranged. A process is terminated when its operations are completed. A process may correspond to a method, a program, a procedure, a method of manufacturing or fabrication, a sequence of operations performed by an apparatus, a machine, or a logic circuit, etc.

Figure 1:
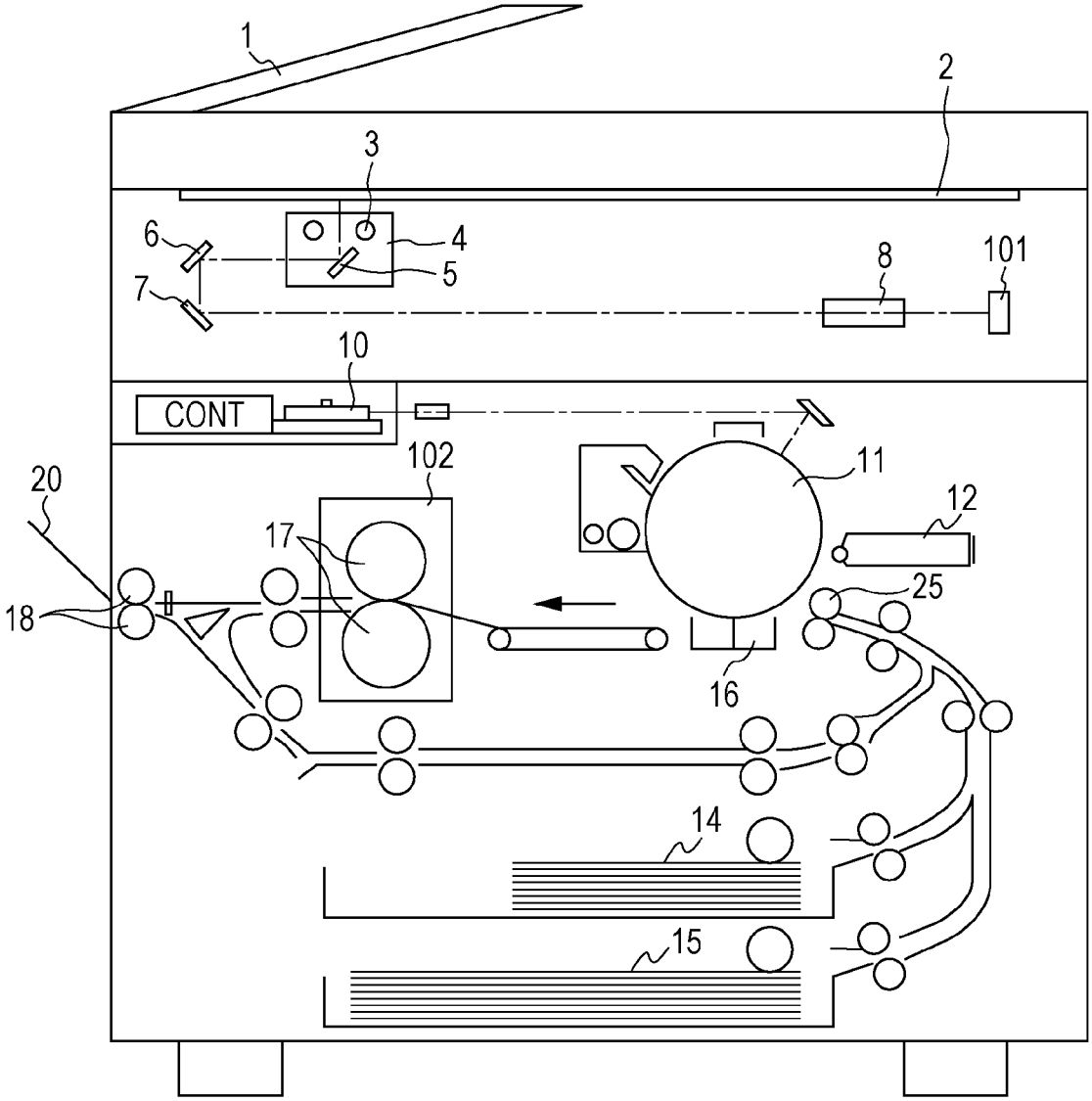
FIG. 1 is a cross-sectional view of an image forming apparatus.

FIG. 1 is a cross-sectional view schematically illustrating a configuration of an image forming apparatus according to an embodiment of the present invention. Referring to FIG. 1, a document reader unit 1 feeds a document placed on a platen to a certain position on a platen glass 2. An image of the document is formed on an image sensor unit 101 through a scanner 4 including a document lamp 3 and a mirror 5, scanning mirrors 6 and 7, and a lens 8. An exposure control unit 10 irradiates a photo conductor 11 with a light beam that is modulated on the basis of the image read by the image sensor unit 101. An electrostatic latent image formed on the photo conductor 11 is developed with developer (toner) by a developing unit 12. A sheet of paper fed from a cassette 14 or 15 is fed to the position of a registration roller 25 by sheet feed rollers that are driven, is stopped once, and is fed again in synchronization with a toner image formed on the photo conductor 11. The toner image on the photo conductor 11 is transferred on the sheet of paper by a transfer separation charger 16 and, then, the sheet of paper on which the toner image is transferred is conveyed to a fixing device 102. The fixing device 102 includes a roller pair 17 including a heating roller and a pressure roller that opposes the heating roller. Passage of the sheet of paper through a nip part formed by the roller pair 17 causes the toner image on the sheet of paper to be fixed by heat. Then, the sheet of paper is discharged into a tray 20 by discharge rollers 18. In the case of duplex image formation, the sheet of paper is reversed and is conveyed again to the registration roller 25 where an image is formed on a second face of the sheet of paper.

Figure 2:
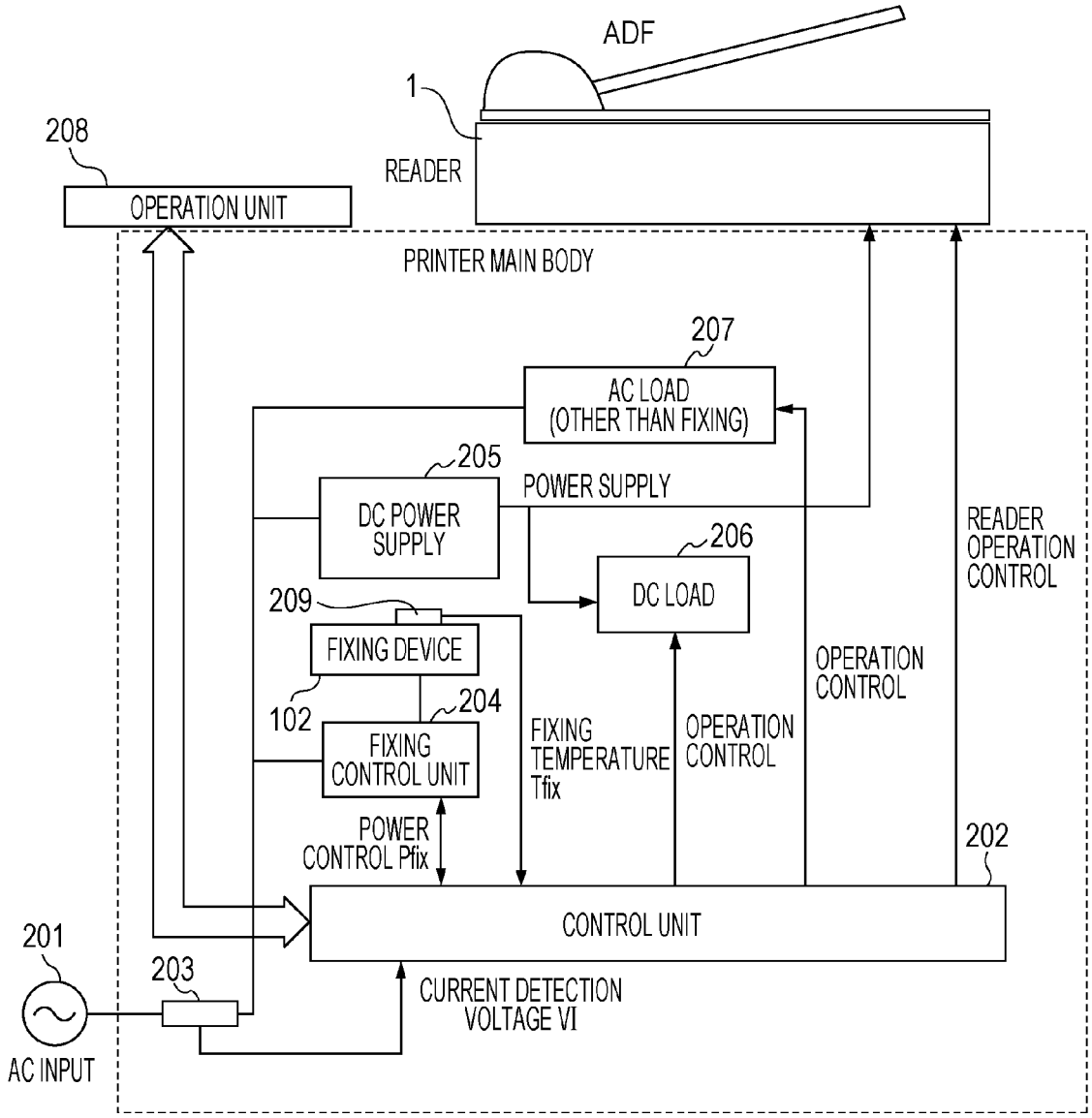
FIG. 2 is a block diagram of the image forming apparatus.

FIG. 2 is a block diagram of the image forming apparatus in the present embodiment. The same reference numerals are used in FIG. 2 to identify the same components shown in FIG. 1.

A control unit 202 controls the operation of a printer module. A current detecting unit 203 outputs a current detection voltage VI in proportion to a current value input into the image forming apparatus from a commercial power supply 201. A fixing control unit 204 controls power to be supplied to the fixing device 102 in accordance with an instruction from the control unit 202. A direct-current (DC) power supply 205 supplies DC power to a DC load 206 and the document reader unit 1. The DC load 206 includes, for example, a motor that drives the rollers through which a sheet of paper is conveyed. The fixing device 102, the DC power supply 205, an alternating current (AC) load 207, etc. are connected to a power line through which an alternating current from the commercial power supply 201 is supplied. The power line is controlled by the control unit 202. A temperature detection sensor (a thermistor) 209 detects the temperature of the fixing device 102 to output a temperature signal Tfix. The control unit 202 controls the temperature of the fixing device 102 on the basis of the temperature detected by the temperature detection sensor 209. An operation unit 208 includes a display where information is displayed and keys used to input an instruction.

Figure 3:
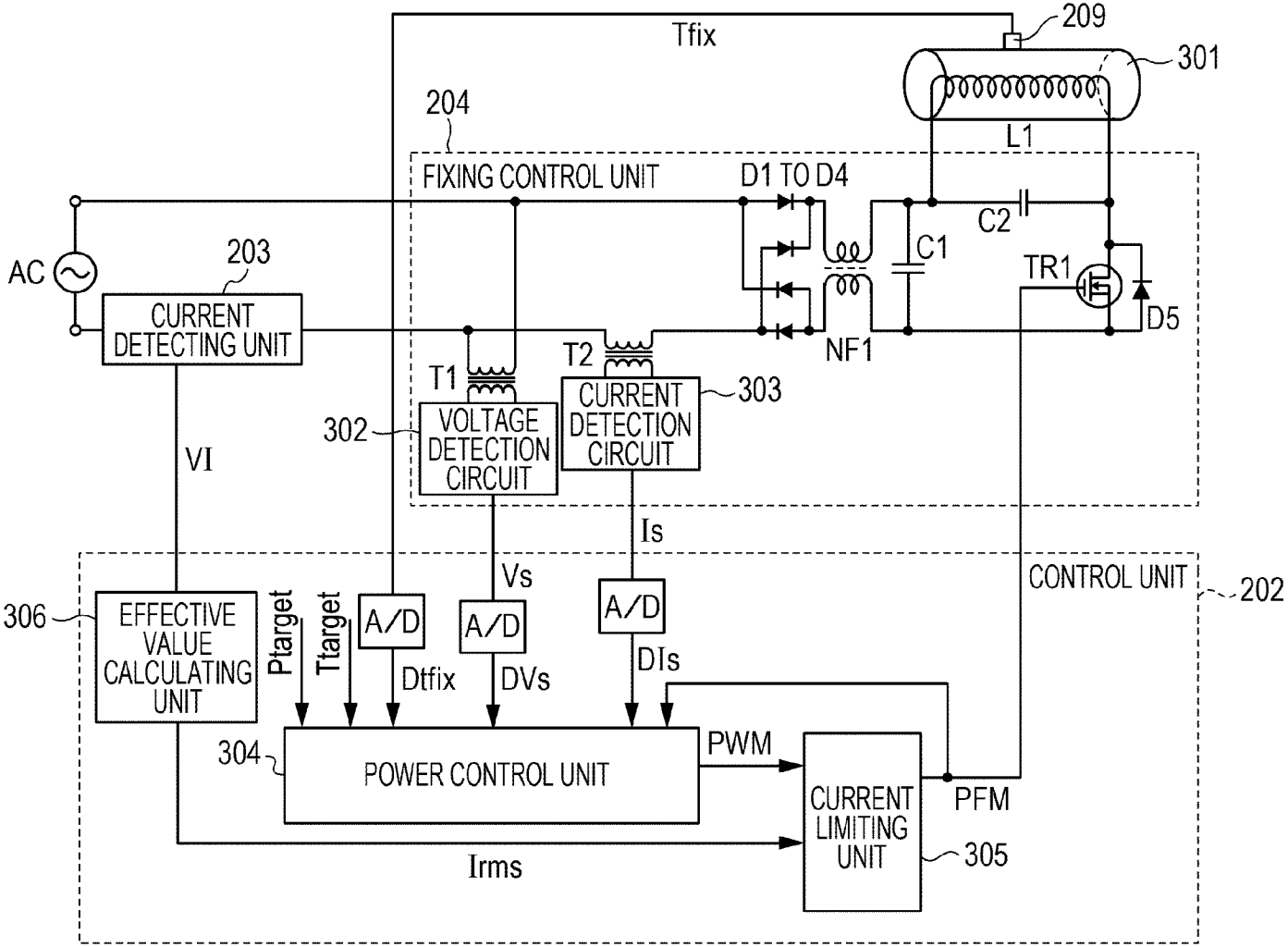
FIG. 3 is a block diagram showing a configuration concerning power control.

FIG. 3 is a block diagram showing a configuration concerning fixing power control in the present embodiment.

Although the fixing device in the present embodiment is an electromagnetic induction heating (hereinafter referred to as IH) fixing device, a fixing unit of another type may be used.

Figure 5:
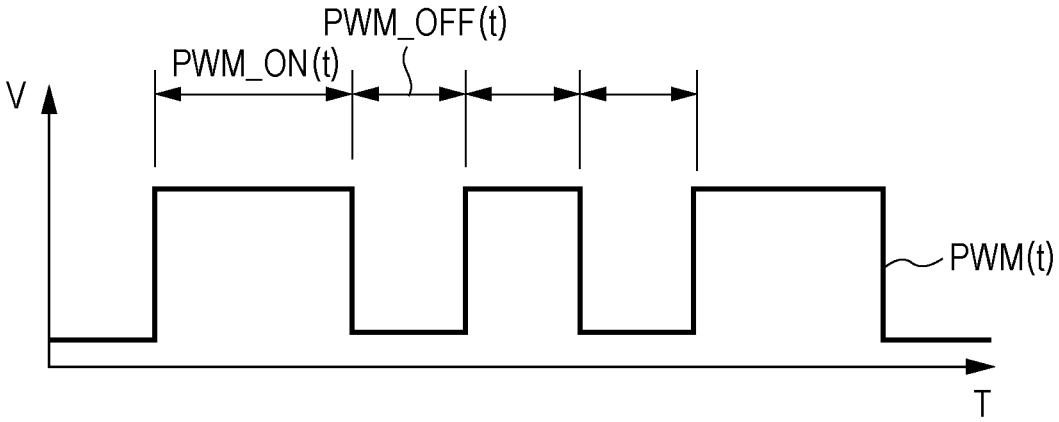
FIG. 5 is a diagram for describing a driving signal PFM.

A heating roller 301 in the fixing device 102 is formed of a magnetic body and includes an induction coil L1 for the electromagnetic induction heating. A resonant capacitor C2 is provided in parallel with the induction coil L1. An AC voltage supplied from the commercial power supply 201 is rectified in rectifier diodes D1 to D4 in the fixing control unit 204, is smoothed by a noise filer composed of a coil NF1 and a capacitor C1, and is oscillated at a high frequency in a switching element TR1. As a result, an induction field is caused to heat the roller 301. A signal PFM used to oscillate and drive the switching element TR1 is supplied from the control unit 202. A protection diode D5 is provided in parallel with the switching element TR1. Power supplied to the fixing device 102 (power consumption) is varied by varying the duty ratio between an on part PFM_ON of the signal PFM used to drive the switching element TR1 and an off part PFM_OFF thereof and the frequency, as shown in FIG. 5.

Simply, the width (time period) of PFM_OFF is fixed and the width (time period) of PFM_ON is varied to vary the oscillation frequency and the duty ratio of the switching element TR1. As a result, the induction field of the induction coil L1 is varied to vary the fixing power that is to be applied. The induction field of the induction coil L1 is increased in size with the increasing time period of PFM_ON (with the increasing ON duty) to increase the fixing power. The fixing control unit 204 includes a transformer T1 detecting the voltage of the received power, a voltage detection circuit 302, and a current detection circuit 303. The voltage detection circuit 302 converts the output from the transformer T1 into a voltage signal Vs corresponding to an AC effective value voltage. The current detection circuit 303 converts the output from a transformer T2 detecting fixing current consumption into a current detection signal Is corresponding to an AC effective value current.

A power control unit 304 receives digital values Dtfix, DVs, and DIs resulting from analog-digital (A/D) conversion of the temperature signal Tfix, the voltage signal Vs, the current detection signal Is, respectively, and outputs a pulse signal PWM to drive the switching element TR1. An effective value calculating unit 306 calculates a current effective value Irms from the driving signal PWM and the current detection voltage VI from the current detecting unit 203. A current limiting unit 305 compares the current effective value Irms supplied from the effective value calculating unit 306 with a predetermined current upper limit value Ilimit (for example, 15 A) and outputs the correction pulse signal PFM so that the current effective value Irms does not exceed the current upper limit value Ilimit to drive the switching element TR1. The correction pulse signal PFM is a signal resulting from correction of the signal PWM. The signal PFM coincides with the signal PWM if Irms≤Ilimit, and the ON width PFM_ON of the signal PFM is smaller than the ON width PWM_ON of the signal PWM if Irms>Ilimit. The signal PFM is also supplied to the power control unit 304 to be used to calculate the signal PWM again.

In other words, the control unit 202 determines the driving signal PFM(t) in order to optimally control the fixing temperature, the fixing power to be supplied to the fixing device 102, and a total amount of current consumption of the image forming apparatus. Specifically, the control unit 202 determines the driving signal PWM(t) in the power control unit 304 every time period Δt on the basis of the input signals Dtfix(t), DIs(t), DIs(t), and the previous driving signal PFM (t-Δt). Then, the control unit 202 determines the driving signal PFM(t) resulting from the correction of the driving signal PWM(t) in the current limiting unit 305.

Figure 4:
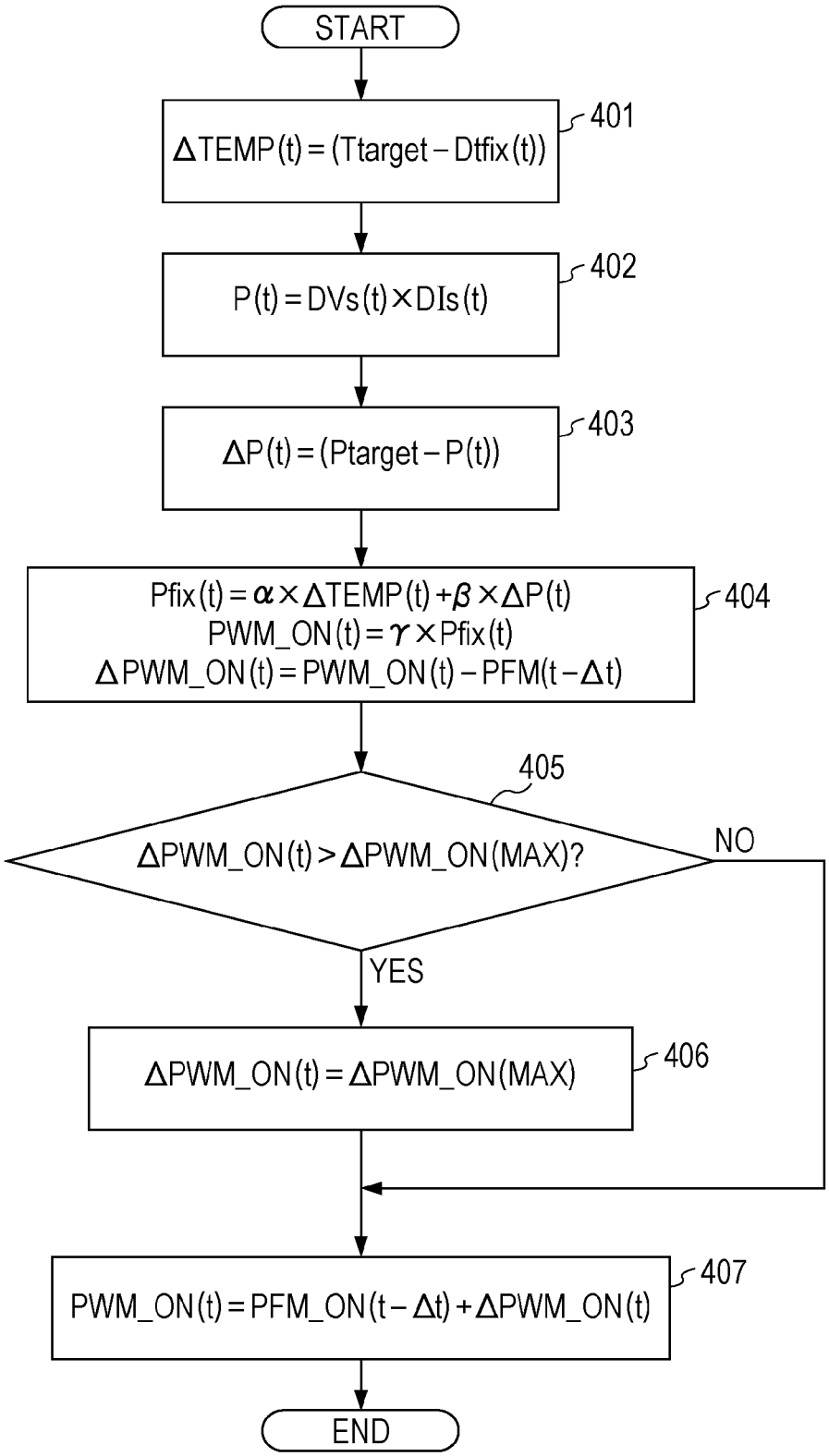
FIG. 4 is a flowchart showing an operational process in a power control unit.

FIG. 4 is a flowchart showing a process of determining the driving signal PWM(t), performed by the power control unit 304.

The power control unit 304 calculates a difference ΔTEMP (t) between a target temperature Ttarget and the temperature data Dtfix(t) measured in the temperature detection sensor 209 (Step 401). Then, the power control unit 304 calculates fixing power P(t) that is actually consumed from the voltage detection signal DVs(t) and the current detection signal DIs(t) (Step 402). The power control unit 304 calculates a difference AP(t) between target power Ptarget and the fixing power P(t) (Step 403). Then, the power control unit 304 calculates the next fixing power Pfix(t) on the basis of the temperature difference ΔTEMP(t) and the power difference AP(t) (Step 404). For example, when a simple proportional control method is used, the power Pfix(t) is calculated according to the following equation:

$$P\text{fix}(t)=\alpha\times\Delta\text{TEMP}(t)+\beta\times\Delta P(t)$$

where α denotes a power conversion factor and β denotes a proportional factor.

In actual calculation, the calculation equation may be determined so as to achieve a desired accuracy and a compliant speed for the target temperature or the target power on the basis of a control theory and the calculation equation is not necessarily limited to the above one.

The power control unit 304 determines PWM_ON(t) on the basis of the calculated Pfix(t) (Step 404). PWM_ON(t) is calculated according to the following equation:

$$PWM_ON(t)=\gamma\times Pfix(t)$$

where γ denotes a proportional multiplier.

In addition, the power control unit 304 calculates a correction ON width ΔPWM_ON(t) on the basis of the difference between the determined PWM_ON(t) and the previous driving signal PFM(t−Δt) (Step 404).

However, greatly varying the ON width (ON time period) of the driving signal results in the fixing power that is greatly varied to be a burden on the fixing control unit 204 and the induction coil L1. This is not preferred in terms of radiation noise from the apparatus. In order to resolve the above problem, according to the present embodiment, a limit value is set for the amount of variation (particularly, the amount of increase) of PWM_ON in one feedback control to prevent the power from being sharply increased. If the determined ΔPWM_ON(t) exceeds an upper limit value ΔPWM_ON(MAX), the power control unit 304 updates ΔPWM_ON(t) to ΔPWM_ON(MAX) (Steps 405 and 406). The power control unit 304 adds ΔPWM_ON(t) to PFM_ON(t−Δt), which is the ON width of the previous driving signal, to determine the ON width PWM_ON(t) of the driving signal PWM(t) to be updated (Step 407).

Figure 7A:
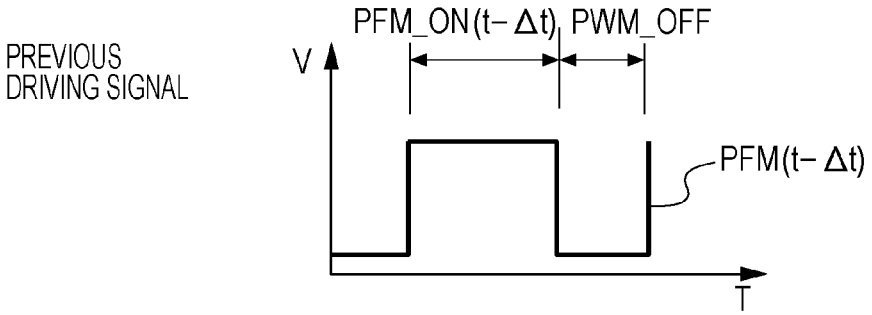
FIGS. 7A to 7D are diagrams showing how to correct an ON width of a driving signal PWM.
Figure 7B:
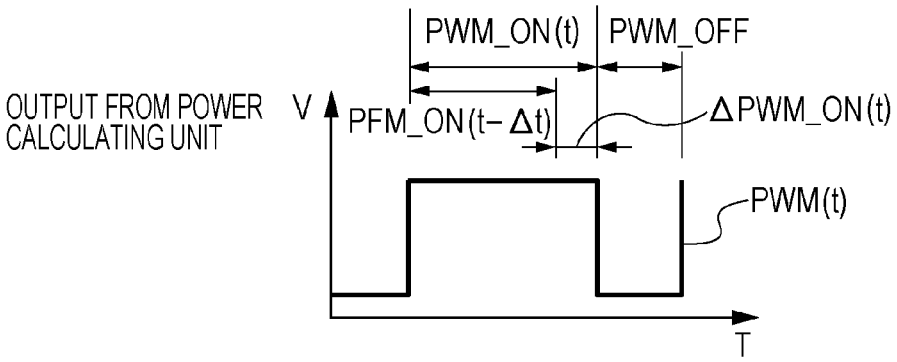

FIGS. 7A to 7D include diagrams schematically illustrating how the ON width of the driving signal PWM is corrected. When the fixing temperature while the driving signal PFM (t−Δt) shown in FIG. 7A is being supplied to the switching element TR1 is lower than the target temperature, the ON width PWM_ON(t) of the driving signal PWM(t) is increased to a value resulting from addition of ΔPWM_ON(t) to PFM_ON(t−Δt), as shown in FIG. 7B. However, the ON width PWM_ON(t) of the driving signal PWM(t) may be smaller than PFM_ON(t−Δt) in some situations.

Figure 6:
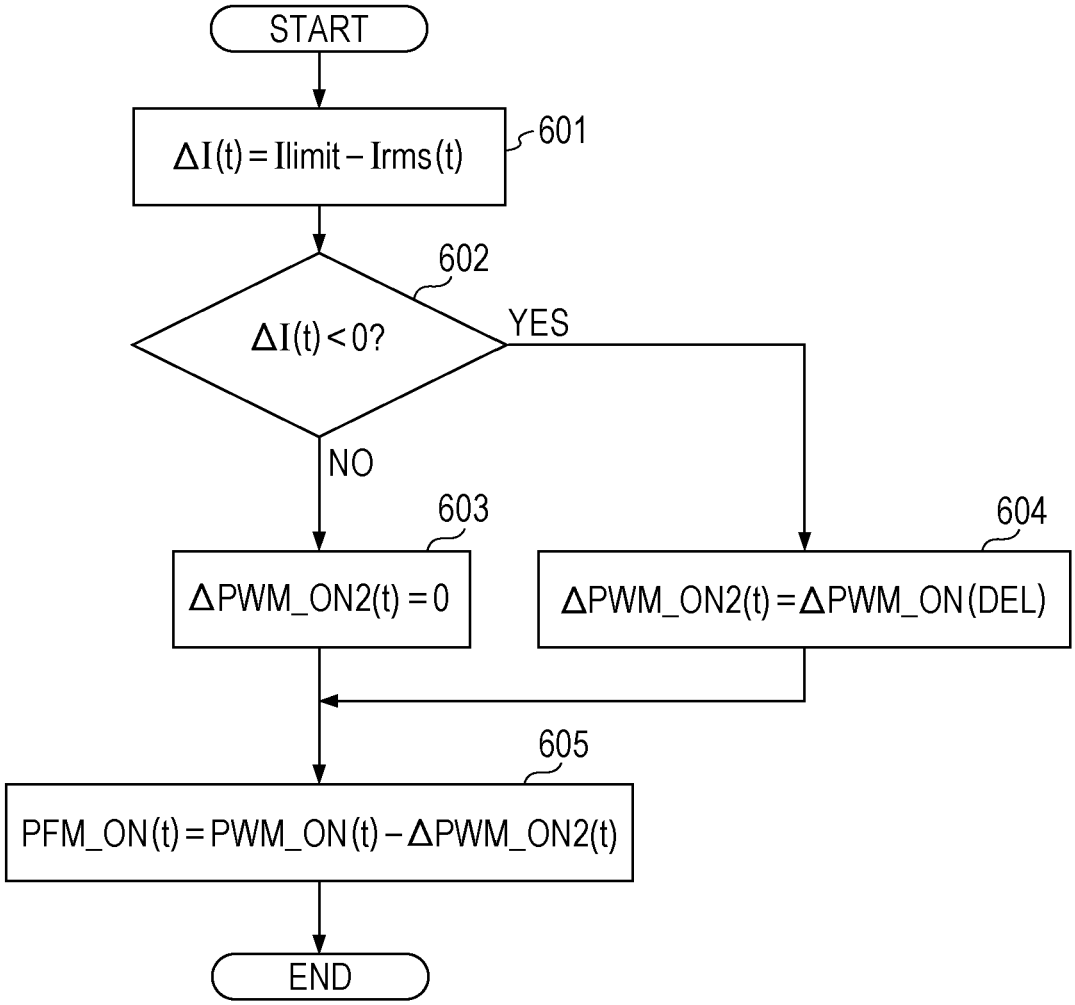
FIG. 6 is a flowchart showing an operational process in a current limiting unit.

FIG. 6 is a flowchart showing a control process of limiting the ON time period of the output PWM(t) from the power control unit 304, performed by the current limiting unit 305. The current limiting unit 305 determines a correction time ΔPWM_ON2(t) used to further correct the ON time period PWM_ON(t) of the driving signal PWM(t) determined by the power control unit 304 in accordance with whether the current effective value Irms exceeds the current upper limit value Ilimit.

The current limiting unit 305 calculates an excess amount of current ΔI(t) from the difference between the current upper limit value Ilimit and the input current effective value Irms(t) (Step 601). Then, the current limiting unit 305 determines whether the calculated ΔI(t) is a positive value (Step 602). If Δ(t)≥0, the current limiting unit 305 sets ΔPWM_ON2(t) to zero (ΔPWM_ON2(t)=0) (Step 603) because the total amount of current consumption of the image forming apparatus is sufficiently lower than the upper limit current value. ΔPWM_ON2(t) denotes an amount of decrease of the ON width of the driving signal PWM(t). If AI(t)<0, the fixing power to be supplied is required to be decreased because the total amount of current consumption exceeds the upper limit current value. In other words, it is necessary to decrease the ON time period PWM_ON(t) of the driving signal PWM(t). The current limiting unit 305 sets ΔPWM_ON2(t) to ΔPWM_ON(DEL) (ΔPWM_ON2(t)=ΔPWM_ON(DEL)) (Step 604). ΔPWM_ON (DEL) is proportional to an amount decrease of the power and is larger than zero (ΔPWM_ON(DEL)>0).

Then, the current limiting unit 305 outputs the driving signal PFM(t) having the ON width PFM_ON(t) resulting from subtraction of ΔPWM_ON2(t) from PWM_ON(t) (Step 605).

Figure 7C:
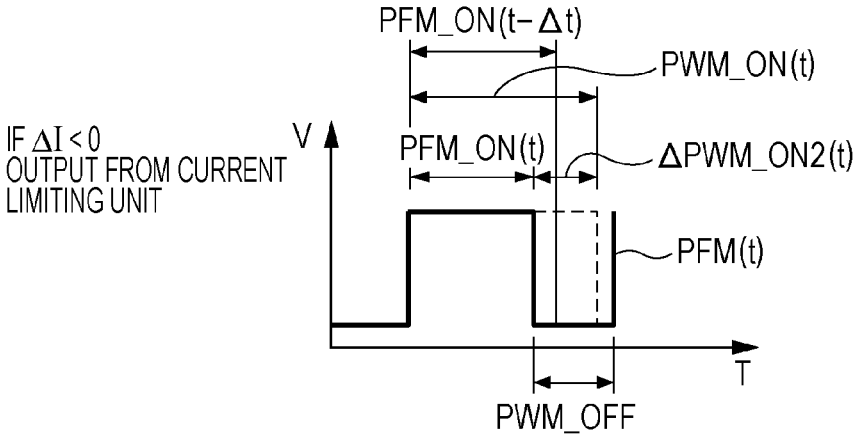
Figure 7D:
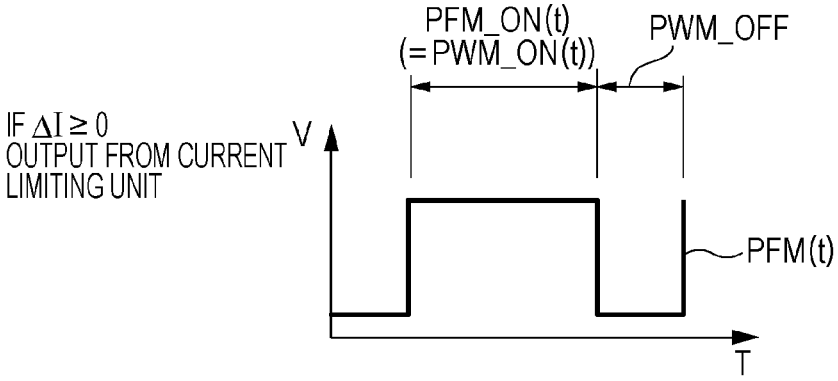

Accordingly, if the current effective value Irms(t) does not exceed the current upper limit value Ilimit, the driving signal PWM(t) output from the power control unit 304 is used as the driving signal PFM(t), as shown in FIG. 7D. However, if the current effective value Irms(t) exceeds the current upper limit value Ilimit, the ON width is limited to PFM_ON(t) resulting from subtraction of ΔPWM_ON2(t) (=ΔPWM_ON(DEL)) from PWM_ON(t), as shown in FIG. 7C. The switching element TR1 in the fixing control unit 204 is turned on or off in accordance with the driving signal PFM(t) and the power corresponding to the ON width is applied to the induction coil L1.

The object of this control process is to decrease the current consumption of the apparatus when the current effective value Irms(t) exceeds the current upper limit value Ilimit and it is necessary to decrease the power of the fixing device for this purpose. Accordingly, the following relationship is established between the correction upper limit value ΔPWM_ON (MAX) in the power control unit 304 and the decrease time ΔPWM_ON(DEL) in the current limiting unit 305 when the current effective value exceeds the upper limit value:

$$\Delta PWM_ON(MAX)<\Delta PWM_ON(DEL)$$

In other words, the ON width of the driving signal decreased by the current limiting unit 305 is larger than the amount of increase of the ON width of the driving signal determined by the power control unit 304.

With the above configuration, even if the power control unit 304 outputs the driving signal to increase the fixing power consumption and the current effective value Irms exceeds the current upper limit value Ilimit, the current limiting unit 305 corrects the driving signal so as to decrease the fixing power consumption. Accordingly, it is possible to prevent the total amount of current consumption of the image forming apparatus from exceeding the upper limit value.

Second Embodiment

Figure 8:
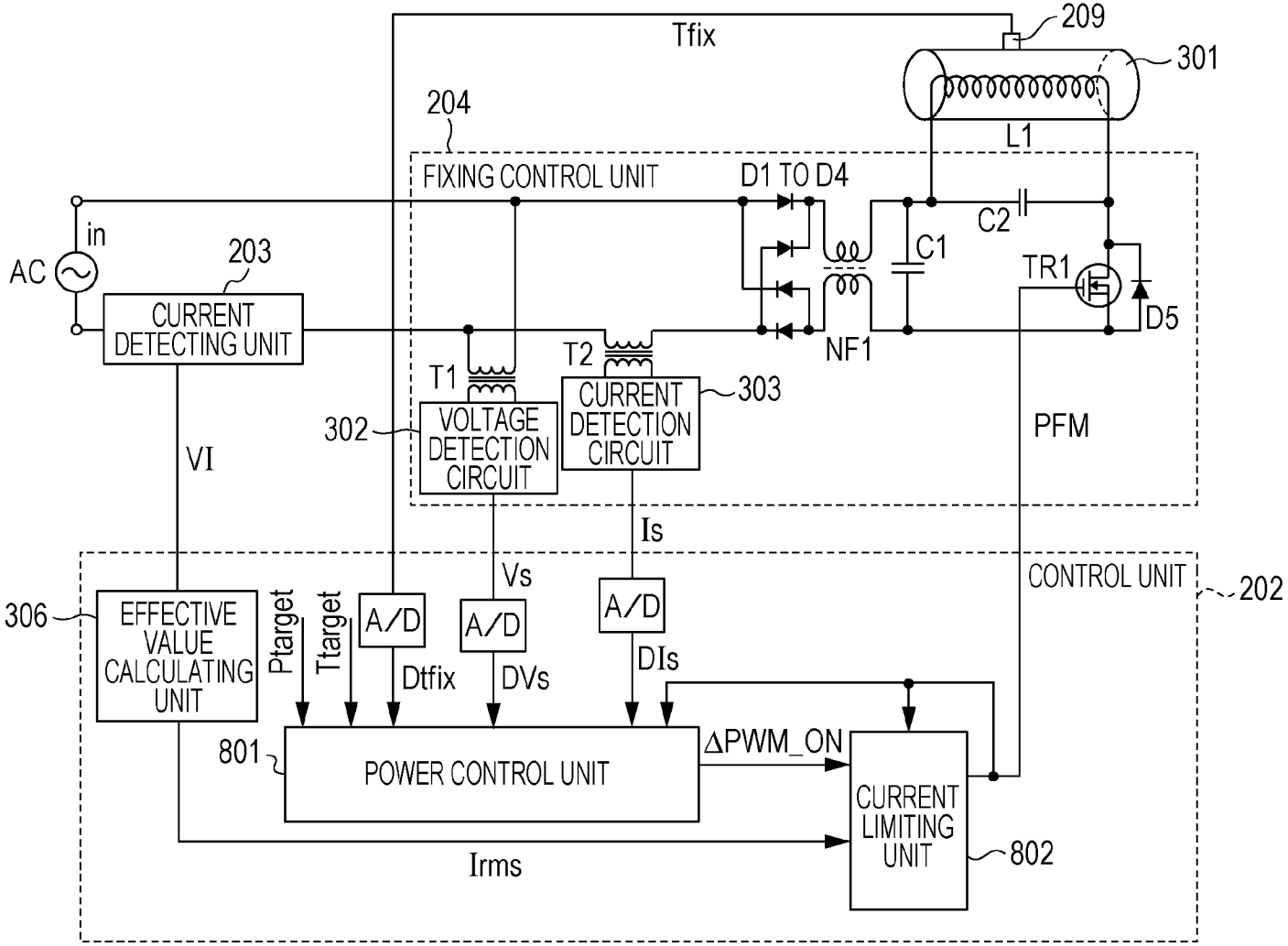
FIG. 8 is a block diagram showing a configuration concerning the power control in a second embodiment.

FIG. 8 is a block diagram showing a configuration concerning the fixing power control according to a second embodiment of the present invention. The same reference numerals are used in FIG. 8 to identify the same components shown in FIG. 3.

A power control unit 801 calculates a correction pulse width of the driving signal on the basis of the difference between the detected temperature and the target temperature of the fixing device 102 and the difference between the fixing power that is actually consumed and the target power and supplies an amount of correction ΔPWM_ON to a current limiting unit 802.

The current limiting unit 802 determines whether an increase of an output ΔPWM_ON from the power control unit 801 causes an excess of the total amount of current and outputs a driving signal PFM corresponding to the result of the determination. The driving signal PFM is fed back to both the power control unit 801 and the current limiting unit 802.

Figure 9:
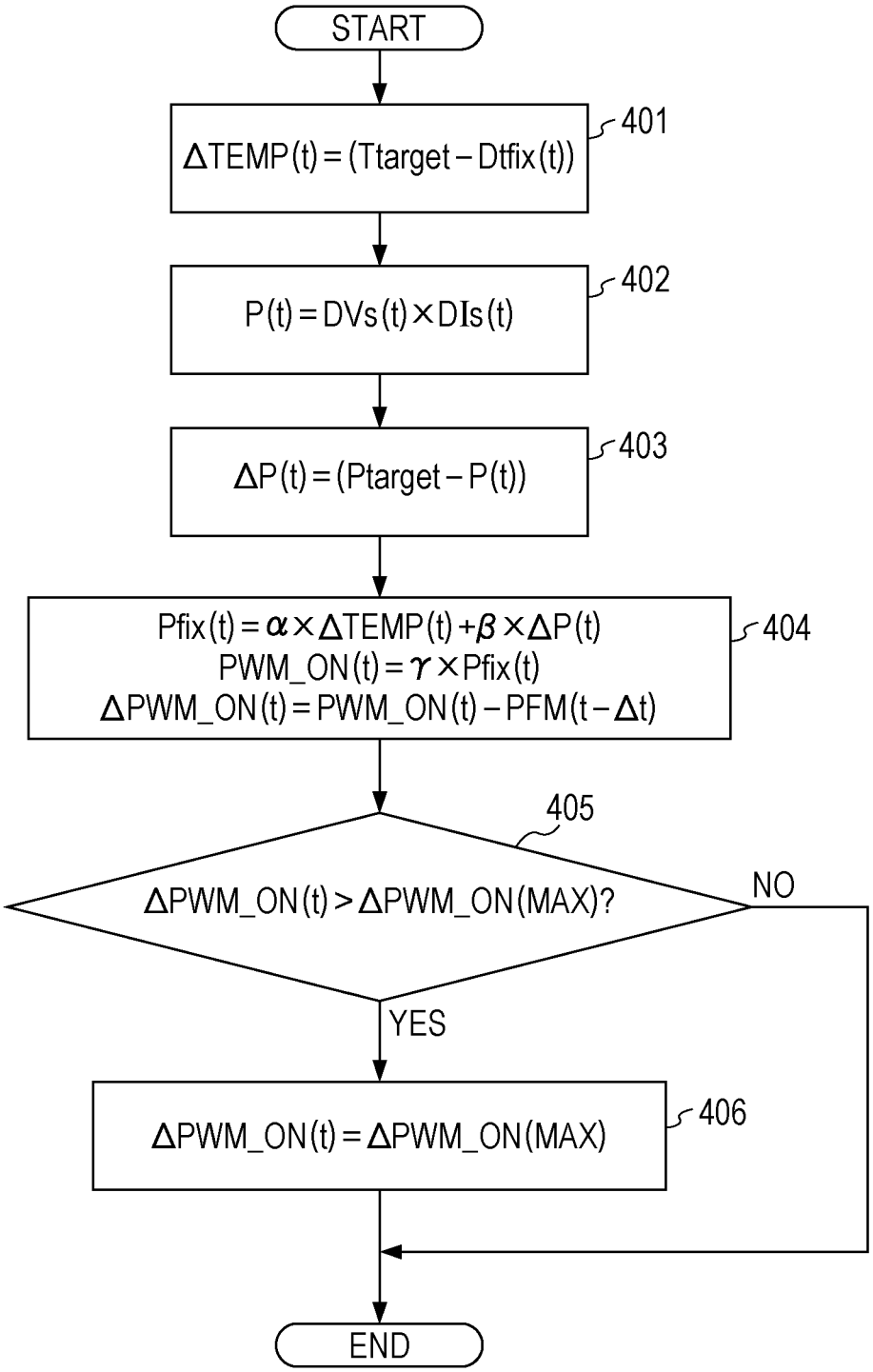
FIG. 9 is a flowchart showing an operational process in a power control unit in the second embodiment.

FIG. 9 is a flowchart showing a process of determining a correction signal ΔPWM_ON(t), performed by the power control unit 801. The same step numbers are used in FIG. 9 to indicate the same processing steps in FIG. 4. The process in FIG. 9 differs from the process in FIG. 4 in that the power control unit 801 supplies only the amount of correction ΔPWM_ON(t) of the ON time period resulting from Steps 401 to 406 to the current limiting unit 802.

Figure 10:
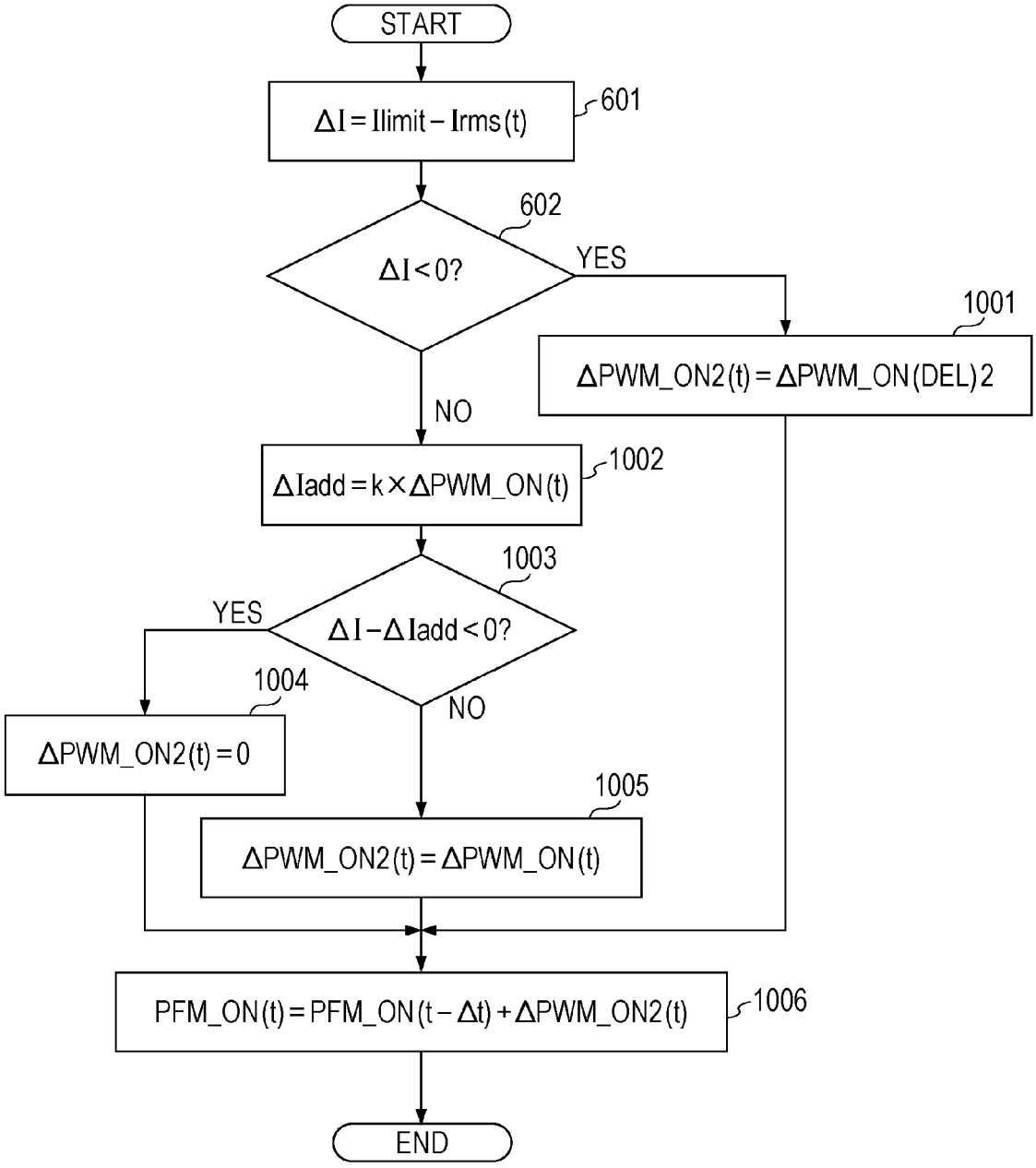
FIG. 10 is a flowchart showing an operational process in a current limiting unit in the second embodiment.

FIG. 10 is a flowchart showing a current limiting operation performed by the current limiting unit 802. The same step numbers are used in FIG. 10 to indicate the same processing steps in FIG. 6.

If the current effective value Irms exceeds the current upper limit value Ilimit in Step 602, the current limiting unit 802 sets a correction value ΔPWM_ON2(t) of the ON time period to a fixed value ΔPWM_ON(DEL)2 so as to decrease the ON time period of the driving signal (Step 1001). ΔPWM_ON(DEL)2 is a predetermined value smaller than zero (ΔPWM_ON(DEL)2<0). If Irms does not exceed Ilimit, the current limiting unit 802 calculates an amount of variation ΔIadd in the fixing current, which is estimated from the correction value ΔPWM_ON(t) of the ON width calculated by the power control unit 801 (Step 1002). ΔIadd is calculated in the following manner: ΔIadd results from multiplication of the difference ΔPWM_ON(t) between the ON time period PFM_ON(t−Δt) of the previous driving signal PFM(t−Δt) and the ON time period PFM_ON(t) of the next driving signal PFM(t) by a conversion factor k.

Then, the current limiting unit 802 determines whether the estimated amount of current variation ΔIadd is larger than ΔI calculated in Step 601 (1003). If the estimated amount of current variation ΔIadd is larger than ΔI, it is estimated that varying the ON time period of the driving signal by ΔPWM_ON2(t)=ΔPWM_ON(t) increases the fixing current consumption to cause the total amount of current consumption of the image forming apparatus to exceed the upper limit value. Accordingly, the current limiting unit 802 sets the amount of correction ΔPWM_ON2(t) of the ON time period to zero (ΔPWM_ON2(t)=0) (1004). In contrast, if the estimated amount of current variation ΔIadd is smaller than ΔI, the current limiting unit 802 varies the driving signal PFM(t) in accordance with the output from the power control unit 801 because it is estimated that the total amount of current consumption of the image forming apparatus does not exceed the upper limit value. Specifically, the current limiting unit 802 sets ΔPWM_ON2(t) to ΔPWM_ON(t) (ΔPWM_ON2(t)=ΔPWM_ON(t)) (1005).

Then, the current limiting unit 802 corrects the ON time period of the output driving signal PFM(t) in the following manner (1006):

$$PFM_\mathrm{ON}(t)=PFM_\mathrm{ON}(t-\Delta t)+\Delta PWM_\mathrm{ON2}(t)$$

ΔPWM_ON(DEL)2 is larger than ΔPWM_ON(MAX) (|ΔPWM_ON(DEL)2|>ΔPWM_ON(MAX)) and ΔPWM_ON(DEL)2 is smaller than zero (ΔPWM_ON(DEL)2<0). Specifically, the ON width of the driving signal decreased by the current limiting unit 802 is larger than the amount of increase of the ON width of the driving signal output from the power control unit 801. As a result, if the total amount of current consumption of the image forming apparatus exceeds the upper limit value, the current limiting unit 802 corrects the driving signal PWM so as to constantly decrease the power consumption of the fixing device regardless of the correction value in the power control unit 801.

With the above configuration, even when the total amount of current consumption does not exceed the upper limit value, the current limiting unit 802 inhibits the correction of the driving signal if it is estimated that the total amount of current consumption after the driving signal PWM is corrected by the power control unit 801 exceeds the upper limit value. Accordingly, it is possible to reduce the probability of the total amount of current consumption that exceeds the upper limit value.

Although the amount of decrease of the ON width in the current limiting unit 305 (ΔPWM_ON(DEL)) and the amount of decrease of the ON width in the current limiting unit 802 (ΔPWM_ON(DEL)2) are fixed values in the first and second embodiments described above, each of the amounts of decrease of the ON width may be set to a value proportional to the amount by which the total amount of current consumption exceeds the current upper limit value.

For example, data about the thickness of a sheet of paper that is fed and/or data about the temperature of the fixing device 102 may be reflected to calculate the correction value of the ON width of the driving signal PWM in each of the power control unit 304 and the power control unit 801.

Although the electromagnetic induction heating fixing device is described in the above embodiments, the control method described above is applicable to a fixing device adopting a heating method using a halogen heater. Specifically, a phase angle may be adjusted, instead of the ON width of the driving signal, in phase control of the power to be supplied to the heater.

Third Embodiment

When the variation in the power consumption occurs in a short time in the measurement of the effective value current of the image forming apparatus, it is desired that the variation in power be rapidly detected. For example, if it takes a time to measure effective value power when the variation in the power consumption occurs in a short time, the control process to increase the power to be supplied to the fixing device is not in time and the temperature of the fixing device may be decreased to cause a failure in fixing. Accordingly, it is necessary to provide a current sensor having a response speed that is sufficiently higher than one period of the AC current from the commercial power supply. Current sensors adopting a current transformer method in which a current value is converted into a voltage value and current sensors adopting a method in which a current is caused to flow through a coil to acquire the magnetic change by a magnetic sensor, such as a hall element, as a voltage signal are known. The voltages of one period are integrated to calculate the effective value current in such a sensor.

However, if the frequency of the commercial power supply is unknown, it is not possible to accurately calculate the effective value current. Accordingly, a method of determining a power supply frequency from the output from the current sensor is proposed, which is disclosed in, for example, Japanese Patent Laid-Open No. 2007-212503.

However, it is not possible to accurately determine the power supply frequency by the above method if the current is varied during the measurement. In addition, the timing at which the measurement is started is limited in the above method.

In order to resolve the above problems, a method of measuring the effective value current with an inexpensive configuration and with a small error will now be described in a third embodiment.

Figure 11:
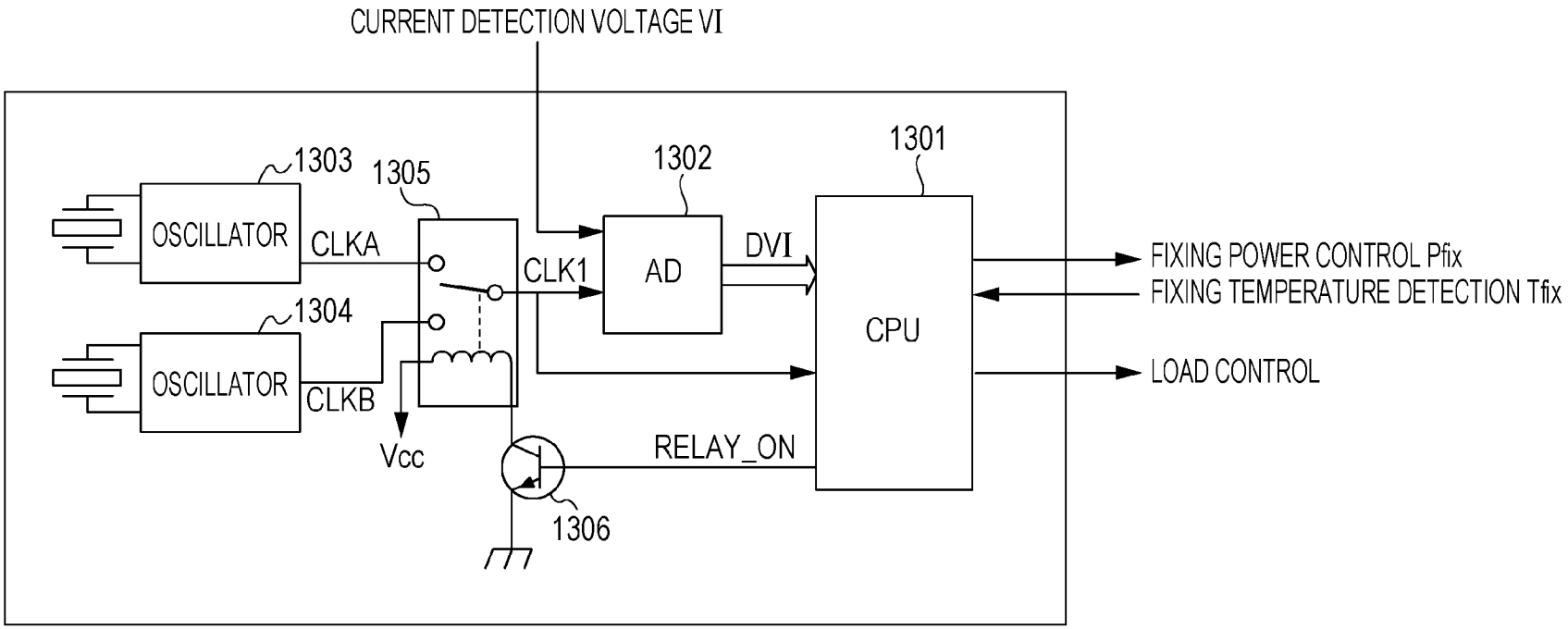
FIG. 11 is a block diagram showing a configuration of an effective-value-current calculating unit in a third embodiment.

FIG. 11 is a block diagram showing a configuration of an effective-value-current calculating unit. A central processing unit (CPU) 1301 acquires a current detection signal DVI subjected to digital conversion in synchronization with a reference clock CLK1 to calculate the current effective value Irms and determines fixing power Pfix from, for example, the calculated current effective value Irms and the detected fixing temperature Tfix or controls the operation of another load. In addition, the CPU 1310 determines the power supply frequency from the output DVI from an AD converter 1302 to output a RELAY_ON signal used to switch a relay 1305. The AD converter 1302 converts the current detection voltage VI into digital data in synchronization with CLK1.

Oscillators 1303 and 1304 generate a first reference clock CLKA and a second reference clock CLKB, respectively. The relay 1305 switches between the clocks CLKA and CLKB in accordance with the switching signal RELAY_ON supplied from the CPU 1301 and uses the clock CLKA or CLKB to which the relay 1305 switches as the clock CLK1.

A transistor 1306 drives a coil in the relay 1305 by using the RELAY_ON signal.

Figure 12:
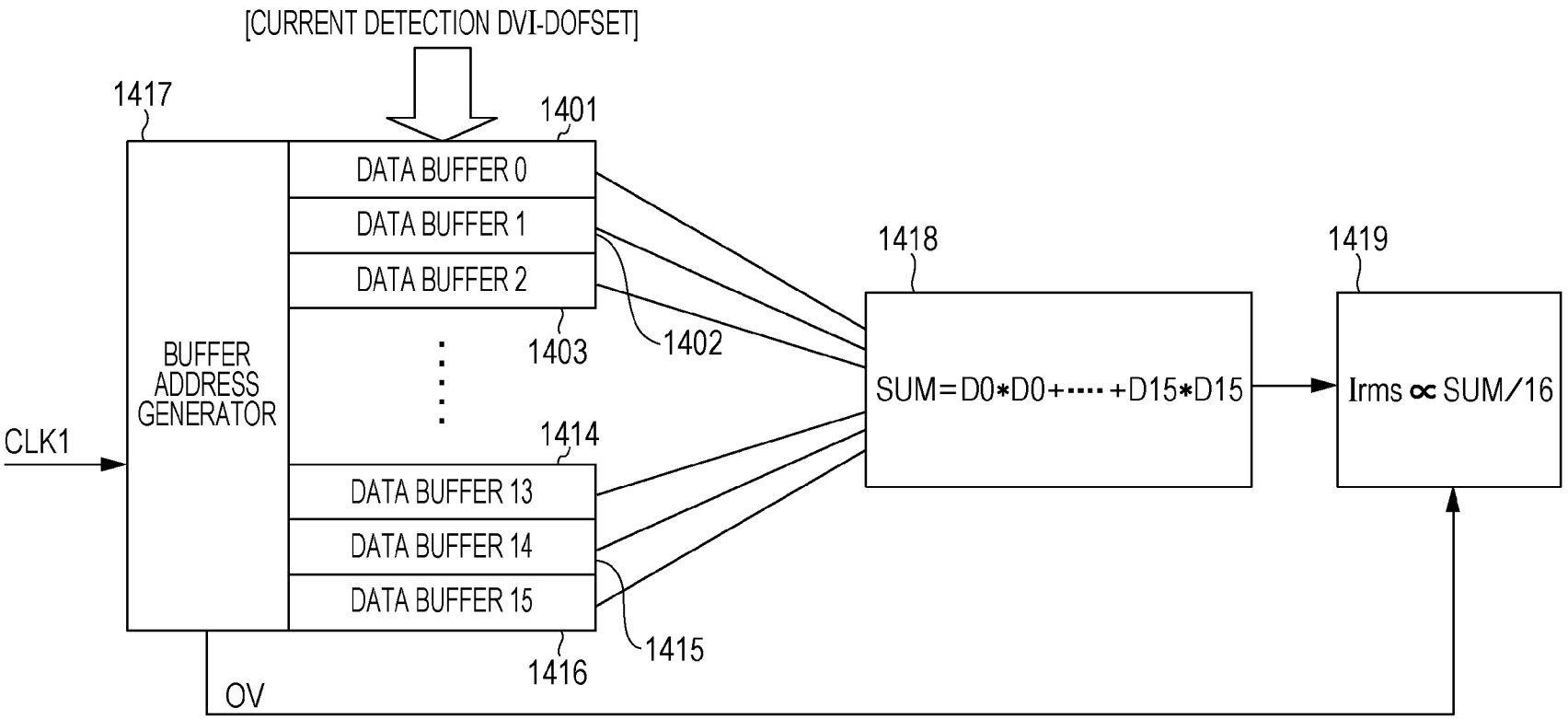
FIG. 12 is a diagram conceptually illustrating calculation of an effective value current in a CPU in the third embodiment.
Figure 17:
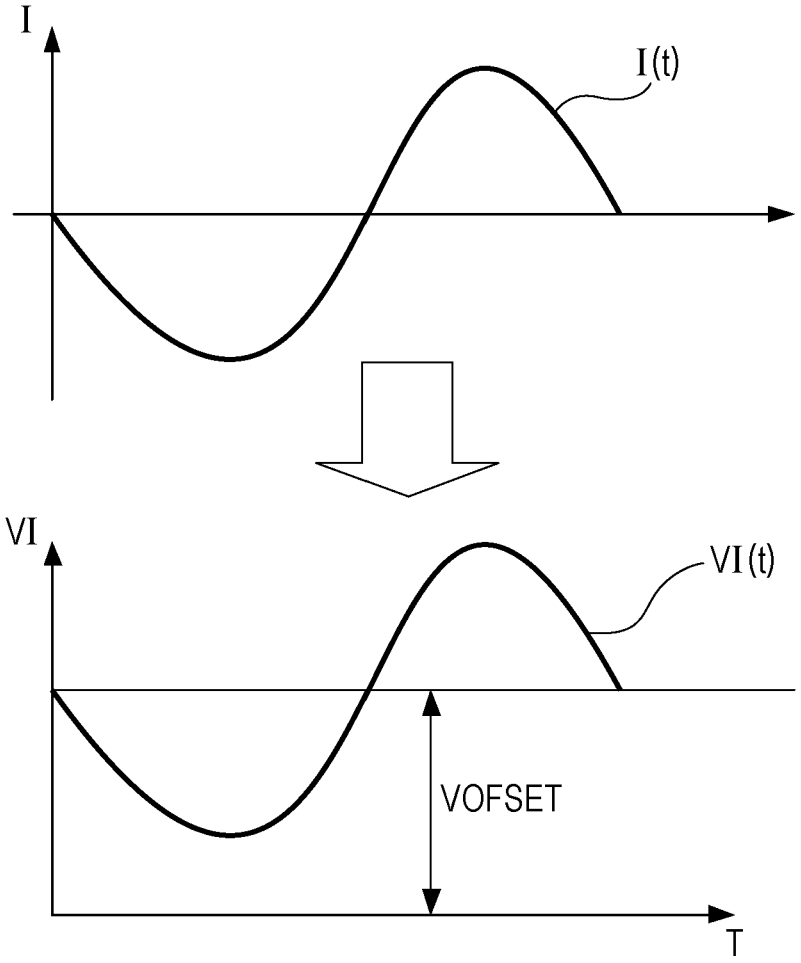
FIG. 17 illustrates a voltage waveform and a reference voltage.

FIG. 12 is a diagram conceptually illustrating an effective-value-current calculator in the CPU 1301. An example in which 16 pieces of data acquired from the AD converter 1302 are used to calculate the effective value current is shown in FIG. 12. The CPU 1301 stores the value resulting from subtraction of a reference value DOFSET from the acquired DVI in any of data buffers 1401 to 1416 in accordance with an instruction from a buffer address generator 1417. DOFSET is a digital value resulting from conversion of a reference voltage VOFSET shown in FIG. 17.

The buffer address generator 1417 sequentially generates addresses 0 to 15 indicating the data buffers 1401 to 1416. The current detection value (DVI-DOFSET) is stored in any of the data buffers 1401 to 1416 indicated by the address. The buffer address generator 1417 increments the address one by one in synchronization with CLK1 and generates an overflow signal OV when the address reaches 15.

An adder 1418 calculates the squares of the values of the buffers 1401 to 1416 and adds up the squares. An effective value calculator 1419 divides the data subjected to the addition in the adder 1418 by 16 to calculate the current effective value Irms. In addition, the effective value calculator 1419 updates the effective value in synchronization with the overflow signal OV from the buffer address generator 1417. The period of the reference clock CLK1 is equal to the time of one power supply period/16. Specifically, the period of CLK1 is set to a period of 1.25 ms, that is, a frequency of 800 Hz if the power supply period is 50 Hz, and the period of CLK1 is set to a period of 1.04 ms, that is, a frequency of 960 Hz if the power period is 60 Hz. The period of the reference clock CLK1 may be set in the above manner to calculate the current effective value Irms for every power supply period. However, the optimal frequency of CLK1 may be appropriately set on the basis of the number of pieces of data to be averaged and the number of power supply periods for which the effective values are calculated.

Figure 13:
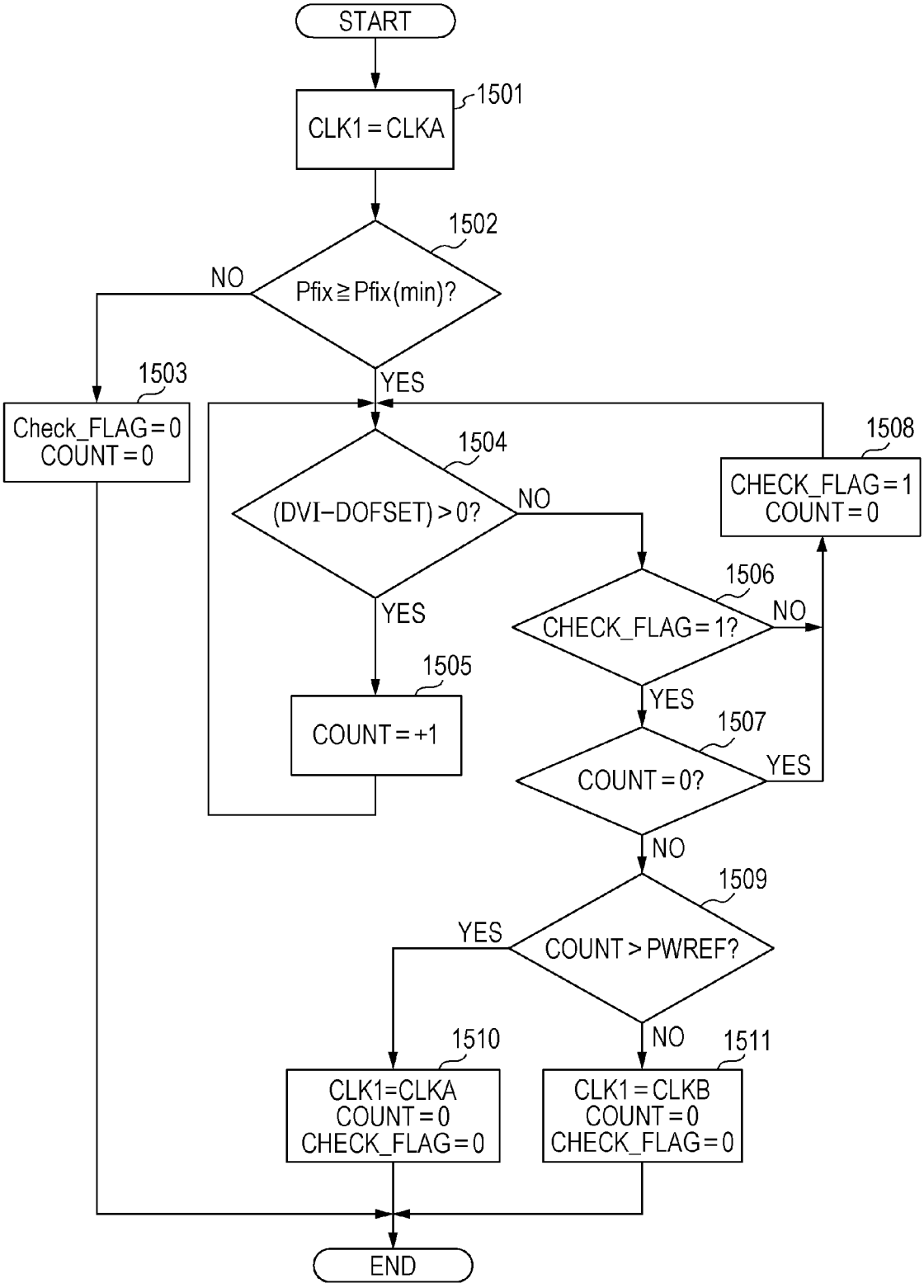
FIG. 13 is a flowchart showing a process of determining a power supply frequency in the third embodiment.

FIG. 13 is a flowchart showing a process of determining the power supply frequency in the CPU 1301. The CPU 1301 outputs the RELAY_ON signal so that the relay 1305 selects CLKA (Step 1501). Then, the CPU 1301 determines whether the fixing power Pfix is higher than or equal to a predetermined minimum power Pfix(min) (Step 1502). If the fixing power Pfix is lower than Pfix(min), the CPU 1301 does not perform the frequency determination and initializes a counter that is used (Step 1503). If the fixing power Pfix is higher than or equal to Pfix(min), the CPU 1301 determines whether the current detection value (DVI-DOFSET) is a positive value (Step 1504). This determination is performed in synchronization with CLK1. If DVI-DOFSET has a positive value, the CPU 1301 increments the detection counter by one (Step 1505). If DVI-DOFSET has a negative value, the CPU 1301 determines whether a frequency detection flag (CHECK_FLAG) is equal to one (Step 1506). If CHECK_FLAG is not equal to one, the CPU 1301 sets CHECK_FLAG to one (CHECK_FLAG=1) and initializes the counter (Step 1508). CHECK_FLAG indicates whether the frequency determination operation is being performed. If CHECK_FLAG is equal to one, the CPU 1301 determines whether a counter value COUNT is equal to zero (Step 1507). If the counter value is equal to zero, the CPU 1301 sets CHECK_FLAG to one (CHECK_FLAG=1). If the counter value is not equal to zero, the CPU 1301 determines whether the counter value is larger than a predetermined value PWREF (Step 1509).

Since the period of CLK1 is 1.25 ms, the counter value COUNT is equal to eight (COUNT=8) in a half period when the power supply frequency is 50 Hz. When the power supply frequency is 60 Hz, the counter value COUNT is equal to six (COUNT=6) in the half period. Accordingly, when PWREF is set to seven (PWREF=7), it is determined that the power supply frequency is 50 Hz if COUNT>PWREF and that the power supply frequency is 60 Hz if COUNT<PWREF. If COUNT>PWREF, the CPU 1301 outputs the RELAY_ON signal so that the relay 1305 selects CLKA, initializes the counter, and sets CHECK_FLAG to zero (CHECK_FLAG=0) (Step 1510). If COUNT<PWREF, the CPU 1301 outputs the RELAY_ON signal so that the relay 1305 selects CLKB, initializes the counter, and sets CHECK_FLAG to zero (CHECK_FLAG=0) (Step 1511). Although the determination cycle in Step 1504 is set to the period of CLK1, the determination cycle is not limited to this as long as the determination cycle is sufficiently shorter than the power supply frequency.

Fourth Embodiment

Figure 14:
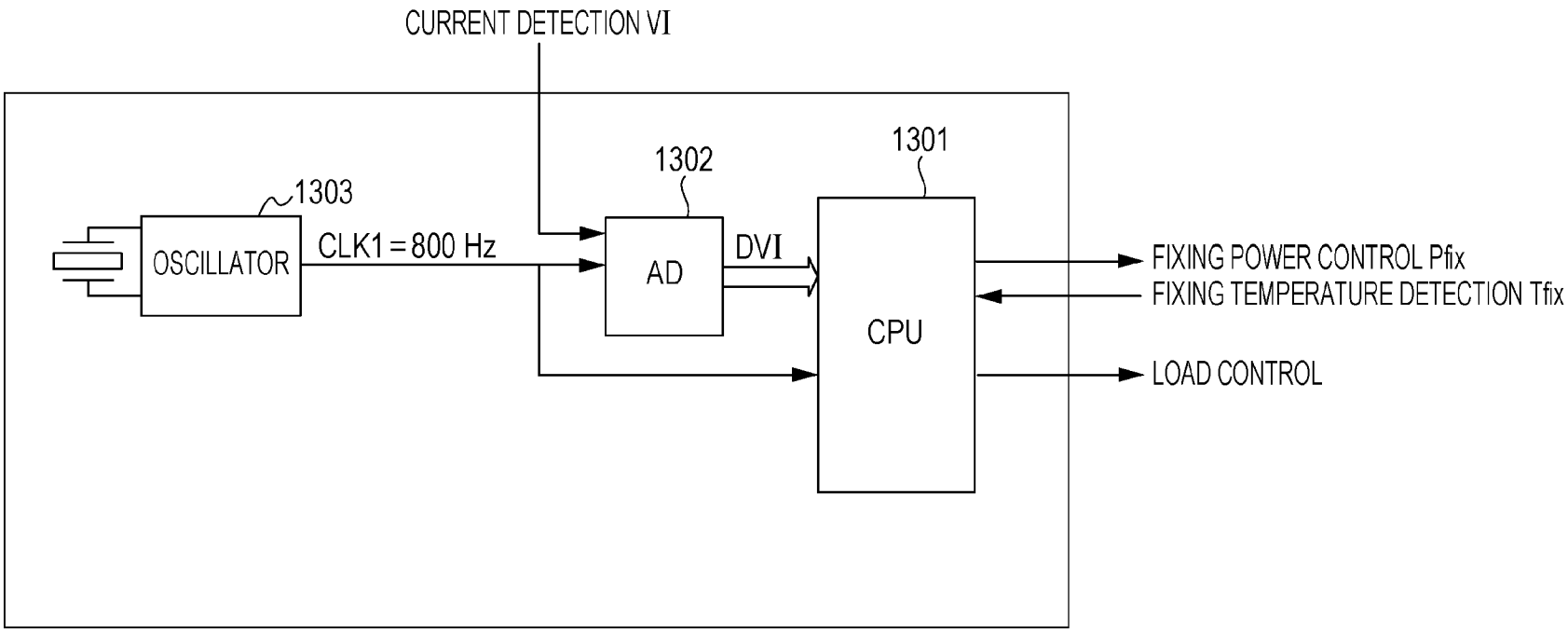
FIG. 14 is a block diagram showing a configuration of an effective-value-current calculating unit in a fourth embodiment.
Figure 15:
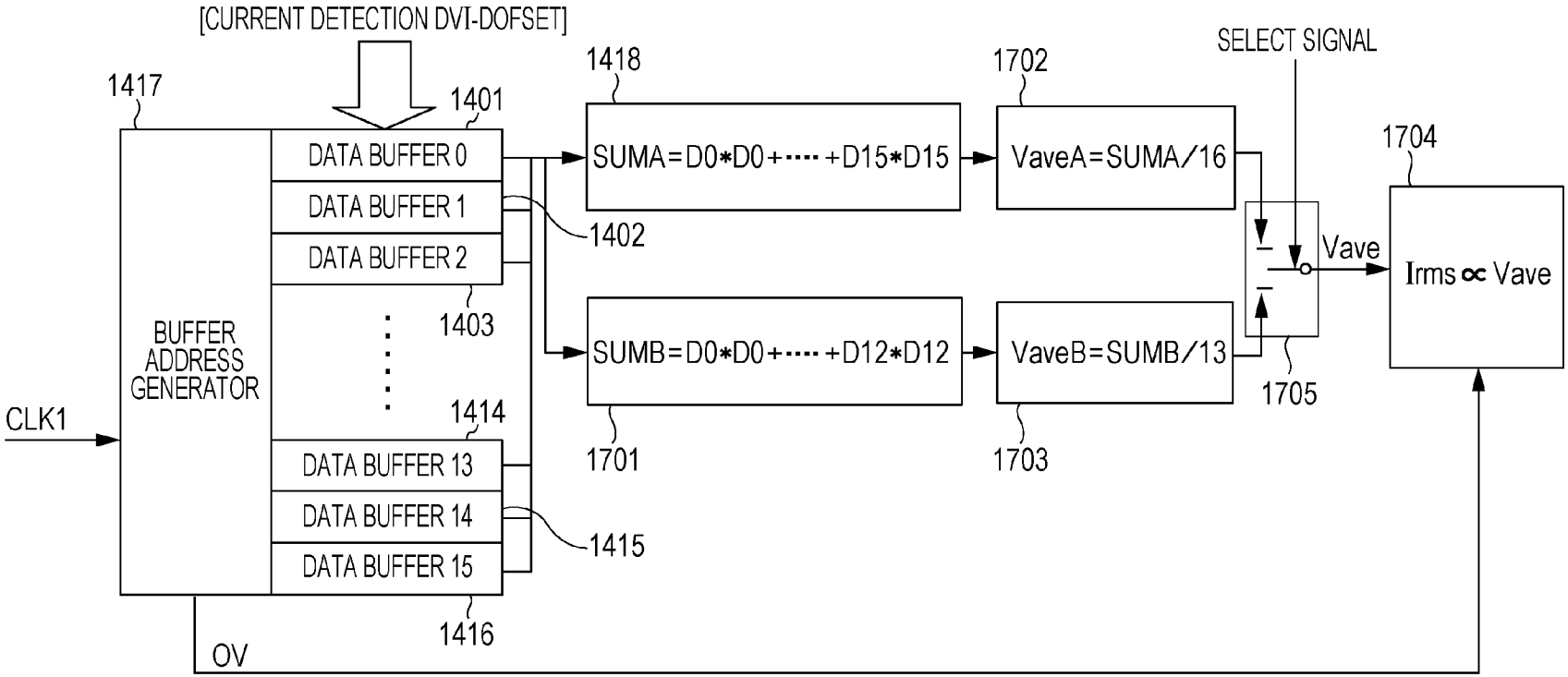
FIG. 15 is a diagram conceptually illustrating calculation of an effective value current in a CPU in the fourth embodiment.
Figure 16:
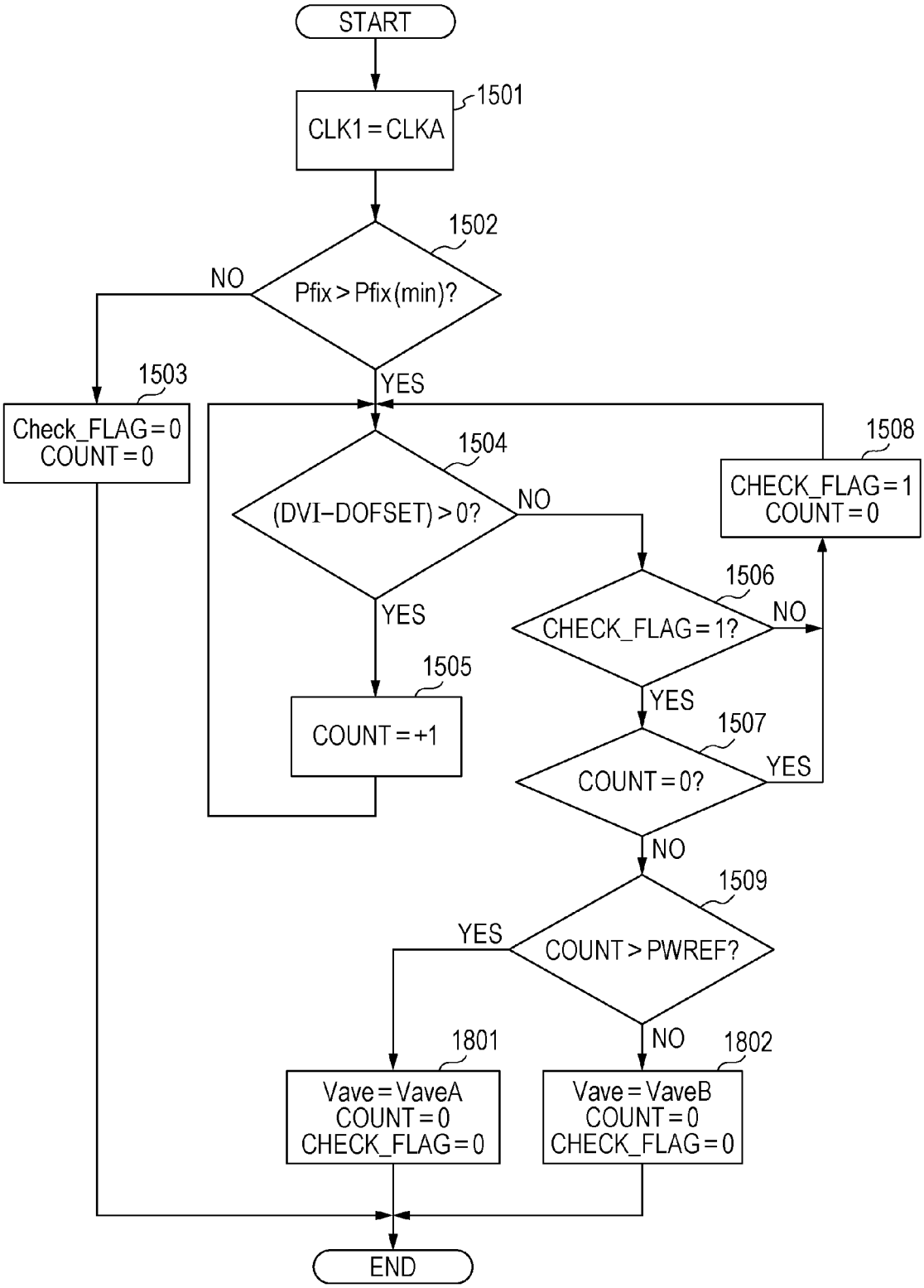
FIG. 16 is a flowchart showing a process of determining a power supply frequency in the fourth embodiment.

FIGS. 14 to 16 illustrate a fourth embodiment. The same reference numerals are used in FIGS. 14 to 16 to identify the same components shown in FIGS. 11 to 13.

FIG. 14 is a block diagram showing a configuration of an effective-value-current calculating unit in the fourth embodiment. The frequency of the reference frequency CLK1 is fixed to 800 Hz in FIG. 14.

FIG. 15 is a diagram conceptually illustrating an effective-value-current calculator in the CPU 1301 in the fourth embodiment. An adder 1701 calculates the squares of the values stored in the data buffers 1401 to 1413 and adds up the squares. Average calculators 1702 and 1703 average the results of the addition in the adder 1418 and the adder 1701, respectively. An effective value calculator 1704 calculates the current effective value Irms from an average result Vave. A switch 1705 selects the calculation result of the average calculator 1702 or 1703 in accordance with a SELECT signal and outputs the selection result to the effective value calculator 1704. The SELECT signal is set in accordance with the result of the determination of the power supply frequency.

Since CLK1 is fixed to 800 Hz, an output VaveA from the average calculator 1702 is equal to the mean square of one period of the power supply frequency 50 Hz, and an output VaveB from the average calculator 1703 is equal to the mean square of one period of the power supply frequency 60 Hz.

FIG. 16 is a flowchart showing a process of determining the power supply frequency in the CPU 1301. The same step numbers are used in FIG. 16 to indicate the same processing steps in FIG. 13. A description of such processing steps is omitted herein. As in the flowchart in FIG. 13, if the CPU 1301 determines in Step 1509 that the power supply frequency is 50 Hz, the CPU 1301 sets the SELECT signal so that the output VaveA from the average calculator 1702 is supplied to the effective value calculator 1704 (Step 1801). If the CPU 1301 determines that the power supply frequency is 60 Hz, the CPU 1301 sets the SELECT signal so that the output VaveB from the average calculator 1703 is supplied to the effective value calculator 1704 (Step 1802).

Figure 18A:
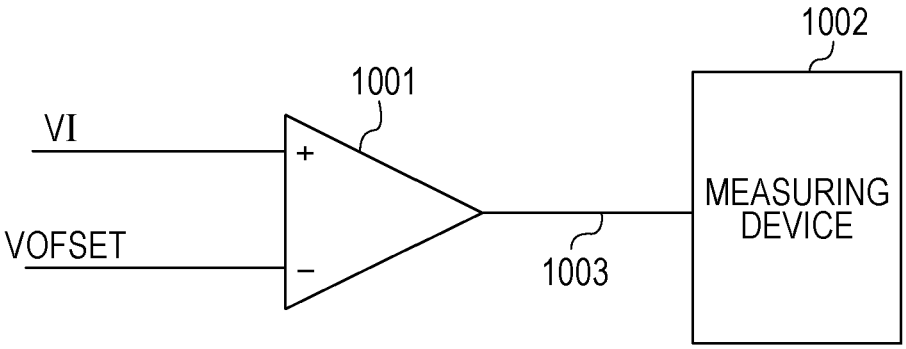
FIGS. 18A and 18B are diagrams showing a modification of determination of a power supply frequency.
Figure 18B:
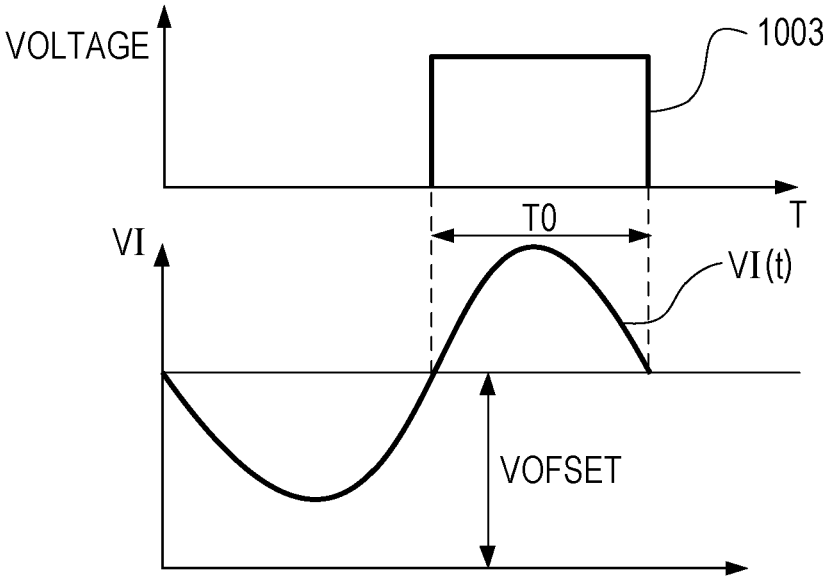

In the frequency determination, a comparator 1001 and a measuring device 1002 may be used to determine the power supply frequency, as shown in FIGS. 18A and 18B. The comparator 1001 compares the current detection voltage VI with the threshold value VOFSET to output a result signal 1003. The measuring device 1002 measures the time of a pulse width T0 of the result signal 1003. The CPU 1301 may function as the measuring device 1002.

Although the two oscillators are provided in the third embodiment, a frequency variable oscillator may be used to configure the apparatus so that the CPU 1301 controls the frequency of the oscillator. In this case, the relay 1305 is not required. With this configuration, an arbitrary power supply frequency may be identified.

In the fourth embodiment, the number of values for which the mean squares concerning the effective value current are calculated may be arbitrarily selected, instead of the selection between, for example, 16 and 13. In this case, a power supply frequency other than 50 Hz and 60 Hz may be identified.

A combination of the number of pieces of data used in the calculation of the effective value current and the frequency of the reference clock may be appropriately determined in accordance with the required accuracy of the effective value current.

In the process of determining the power supply frequency, the multiple measurement results may be evaluated by majority decision, instead of the use of one value measured in one period of the power supply frequency.

It is possible to realize an image forming apparatus capable of clearing the difference between power that is set and power that is actually input, preventing current consumption from exceeding an upper limit value, and efficiently operating within certain power.

Disclosed aspects of the embodiments may be realized by an apparatus, a machine, a method, or a process to perform operations as described above. The method may be a computerized method to perform the operations with the use of a computer, a machine, a processor, or a programmable device. The operations in the method involve physical objects or entities representing a machine or a particular apparatus (e.g., an image forming apparatus, a fixing unit, a toner image, a sheet). In addition, the operations in the method transform the elements or parts from one state to another state. The transformation is particularized and focused on controlling power in an image forming apparatus. The transformation provides a different function or use such as increasing or decreasing power by an increase amount or a decrease amount, respectively.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2011/059560, filed Apr. 18, 2011, which is hereby incorporated by reference herein in its entirety.

The invention claimed is:

1. An image forming apparatus comprising:

an image forming unit configured to form a toner image on a sheet;

a fixing unit configured to fix the toner image formed on the sheet by heat;

a temperature detection unit configured to detect a temperature of the fixing unit;

a power measurement unit configured to measure a fixing power consumption to be consumed by the fixing unit;

a current measurement circuit configured to measure a current flowing from the alternating power supply to the image forming apparatus; and a control unit configured to determine a second fixing power to be supplied to the fixing unit based on a temperature difference between a temperature to be detected by the temperature detection unit and a target temperature of the fixing unit, the fixing power consumption measured by the power measurement unit, and a first fixing power determined previously, and to generate a control signal for supplying the determined power to the fixing unit, wherein, in a case where a second controlling value for obtaining the second fixing power is larger than a first controlling value for obtaining the first fixing power for more than or equal to a first predetermined value, the control unit is configured to correct the second controlling value to a controlling value obtained by adding the first predetermined value to the first controlling value, and wherein, in a case where the current measured by the current measurement circuit exceeds a predetermined upper limit value, the control unit is configured to control a power to be supplied to the fixing unit based on a third controlling value which is obtained by subtracting a second predetermined value from the second controlling value.

2. The image forming apparatus according to claim 1, wherein the control unit is configured to output a PWM signal for supplying the determined power to the fixing unit.

3. The image forming apparatus according to claim 1, wherein the fixing unit comprises an induction heating coil and a switching element configured to turn on and off the power supplying the induction heating coil, and wherein the control unit determines a PWM signal for driving the switching element as the control signal.

4. The image forming apparatus according to claim 3, wherein the control unit determines the correction amount of the control signal based on a difference between the determined ON width of the PWM signal and ON width of previous PWM signal.

5. The image forming apparatus according to claim 1, wherein the second predetermined value is larger than the first predetermined value.

* * * * *